United States Patent [19]

Kawata

[11] Patent Number: 4,860,652

[45] Date of Patent: Aug. 29, 1989

[54] MESH ROLLER FOR PLANOGRAPHY

[75] Inventor: Tomoshi Kawata, Kanagawa, Japan

[73] Assignee: Kabushikigaisha Tokyo Kikai Seisakusho, Tokyo, Japan

[21] Appl. No.: 50,557

[22] Filed: May 18, 1987

[30] Foreign Application Priority Data

May 24, 1986 [JP] Japan ..... 61-119901
May 30, 1986 [JP] Japan ..... 61-126686

[51] Int. Cl.[4] ..... B41F 31/26

[52] U.S. Cl. ..... 101/348; 29/132

[58] Field of Search ..... 101/160, 150, 153, 154, 101/170, 348, 349, 350; 29/121.2, 132

[56] References Cited

U.S. PATENT DOCUMENTS

| | | | |
|---|---|---|---|
| 2,620,730 | 12/1952 | Gilbert | 101/367 |
| 4,009,658 | 3/1977 | Heurich | 101/350 X |
| 4,301,730 | 11/1981 | Heurich et al. | 101/348 |
| 4,391,879 | 7/1983 | Fabian | 101/170 |
| 4,407,196 | 10/1983 | Matalia | 101/363 |
| 4,503,769 | 3/1985 | Andersen | 101/170 |
| 4,567,827 | 2/1986 | Fadner | 101/150 |
| 4,637,310 | 1/1987 | Sato et al. | 101/348 X |

FOREIGN PATENT DOCUMENTS

| | | | |
|---|---|---|---|
| 627319 | 7/1963 | Belgium | 101/348 |
| 58-42463 | 3/1983 | Japan . | |
| 58-56855 | 4/1983 | Japan . | |
| 58-56856 | 4/1983 | Japan . | |
| 59-204558 | 11/1984 | Japan . | |
| 60-44394 | 3/1985 | Japan . | |
| 86243 | 5/1985 | Japan | 29/132 |
| 114852 | 6/1986 | Japan | 101/348 |
| 1273206 | 12/1986 | Japan | 29/132 |

*Primary Examiner*—Cliford D. Crowder
*Attorney, Agent, or Firm*—Foley & Lardner, Schwartz, Jeffery, Schwaab, Mack, Blumenthal & Evans

[57] ABSTRACT

A mesh roller for planography. Its external surface is formed with a protruded surface and a plurality of fine cells for storing ink. The surface is made of or covered with a combination of a high hard material and a lipophilic metal material. According to the first aspect, the center area of its protruded surface is composed of or covered with a lipophilic metal material and the border edge between the protruded surface and the cells is composed of or covered with a high hard material. According to the second aspect, the protruded surface is composed of or covered with a mixture of a high hard material and a lipophilic metal material which are finely mixed each other. This mesh roller can be provided with a superior wear resistance against a high pressed scraping motion of a doctor blade and a high ability of ink reservation by preventing a lipophilic metal material from water soiling.

15 Claims, 4 Drawing Sheets

MESH ROLLER FOR PLANOGRAPHY

BACKGROUND OF THE INVENTION (1) Field of the Invention

The present invention relates to a mesh roller such as Anilox roller, Ami roller, screened roller, and so on which can supply a measured quantity of ink. More particularly, the present invention relates to a specially designed mesh roller adapted for planography.

(2) Description of the Prior Art

Commonly used mesh rollers for a planographic machine are made of copper, copper alloy and the like having a lipophilic property (an affinity for ink, hydrophobic property, and so on). The surface of such mesh roller is formed with many recessed sections in a fine cell form and a protruded section, the residue of the recessed sections. In planography this mesh roller generally functions as follows.

Ink stored in an ink pan is firstly sucked by a fountain roller and then the sucked ink is supplied to the mesh roller from the surface of the fountain roller. The mesh roller is subjected to the scraping of a doctor blade so as to scrape the ink from the surface of the mesh roller. After this scraping some ink remains in the fine cells formed in the surface of the mesh roller. The remaining ink is supplied to a form roller and a plate cylinder.

As is well known, an offset printing process requires water for the plate cylinder in addition to ink. If an ink supplying step is simplified by using the mesh roller, the excess of the supplied water will flow back to the mesh roller surface via an ink supplying roller and thus the excess water will flow into the ink pan. This excess water will dilute the ink and finally make its printing clearness worsen. On the other hand, the surface of the mesh roller should be made of a wear-resistant material such as a chromium treated material to resist the wearing pressure caused by the hard pressing the doctor blade onto the external surface of the mesh roller. The chromium treated surface is hydrophilic, so that the surface attracts water. If the cells of the mesh roller for supplying the ink are filled with this water, the ink can not be constantly supplied to the plate cylinder.

In order to prevent the cells from water-immersing and thus guarantee the constantly measured quantity of ink to be supplied to the plate cylinder, the previous inventions; Japanese Patent Application Publications No. Sho. 58-42463 and 59-204558, have provided cells whose inner surface is treated with a lipophilic material such as copper plating.

Further, another previous invention; Japanese Patent Application Publication No. Sho. 58-56856, has provided an improved mesh roller whose external surface is deposited with a beryllium-copper layer instead of hydrophilic chromium material and the surface layer excluding the cells are subjected to a heat curing treatment to ensure the wear resistance and prevent the external surface from water immersing.

Although the external surface of the mesh roller is treated with a heat-cured lipophilic copper alloy instead of a hydrophilic chromium, this copper alloy treated mesh roller can not improve its durability against the scraping motion of the doctor blade. Therefore this mesh roller requires work time for exchanging or repairing it. This will reduce the working efficiency of this printing process. Thus it is required to treat the surface of the mesh roller with a non-hydrophilic (lipophilic) having a superior durability at least ten times that of conventional types.

In order to provide the wear-resistance to the roll surface conventional arts have commonly employed a ceramic coating on the surafce. For example, USP. No. 4,301,730 has provided an improved manner to ensure the corrision resistance. A ceramic layer is deposited on the surafce of an Anilox roll by means of a flame coating and thereafter the pores of the ceramic layer are sealed with a polymer sealing material.

Also Japanese Patent Application Publication No. Sho. 58-56855 has provided the wear-resistance and lipophilic property to its mesh roller by providing a ceramic layer and immersing oil into the pin holes of the ceramic layer.

Further, Japanese Patent Application Publication No. Sho. 60-44394 has suggest the the surface of a normal type ink roller is coated with a porous ceramic layer by a flame coating and the pores are treated with a lipophilic resin.

However, the surafce of each roller of the above described prior arts is provided with the ultra-hard type ceramic material and the lipophilic material, mixed thereto, such as fluid oil, polymer, resin and the like. Although such lipophilic materials are inherently easy to conduct the sealing treatment, they are inferior to copper or copper alloy with respect to the lipophilic and non-hydrophilic properties required to the mesh roller for a planography. Further, such polymer and resin have a poorer thermal conductivity than the copper or copper alloy, and thus they can not effectively transmit the heat generated by high pressingly scraping motion of the doctor blade. As a result, this heat will raise the temperature of the roller surface. Because of this heat the ink solvent at the roller surface will be evaporated and further the polymer and resin per se will be easily deteriorated by this heat. This phenomenon will make the printing ink unstable and the durability of the printing roller poor. The quality of the printed matters produced by such conventional devices will be also unstable and poor.

SUMMARY OF THE INVENTION

The present invention has been made to solve those problems in the conventional devices.

Accordingly, it is an object of the present invention to provide a mesh roller for planography, provided with a superior wear-resistance, effective over a long period, against a high pressure scraping motion of a doctor blade.

Another object of the present invention is to provide a mesh roller for planography, provided with a high ability of ink reservation by preventing a lipophilic metal material from water soiling.

In order to accomplish the above described objects, the surface of the mest roller according to the present invention is made of or covered with a combination of a high hard material and lipophilic metal material.

According to the first aspect of the present invention, the mesh roller surface comprises a plurality of recessed cells and a protruded section. The center area of the protruded section is composed of or covered with a lipophilic metal material and the border edge of the protruded section with the recessed cells is composed of or covered with a high hard material.

According to the second aspect of the present invention, the mesh roller surface is composed of or covered with a mixture of a high hard material and a lipophilic metal material, finely mixed with each other.

The above and other objects, features and advantages of the present invention will become apparent from the following description taken in connection with the accompanying drawings wherein preferred embodiments thereof are illustrated by way of example.

DETAILED DESCRIPTION OF THE PREFERRED EMBODIMENTS

Figure 1:
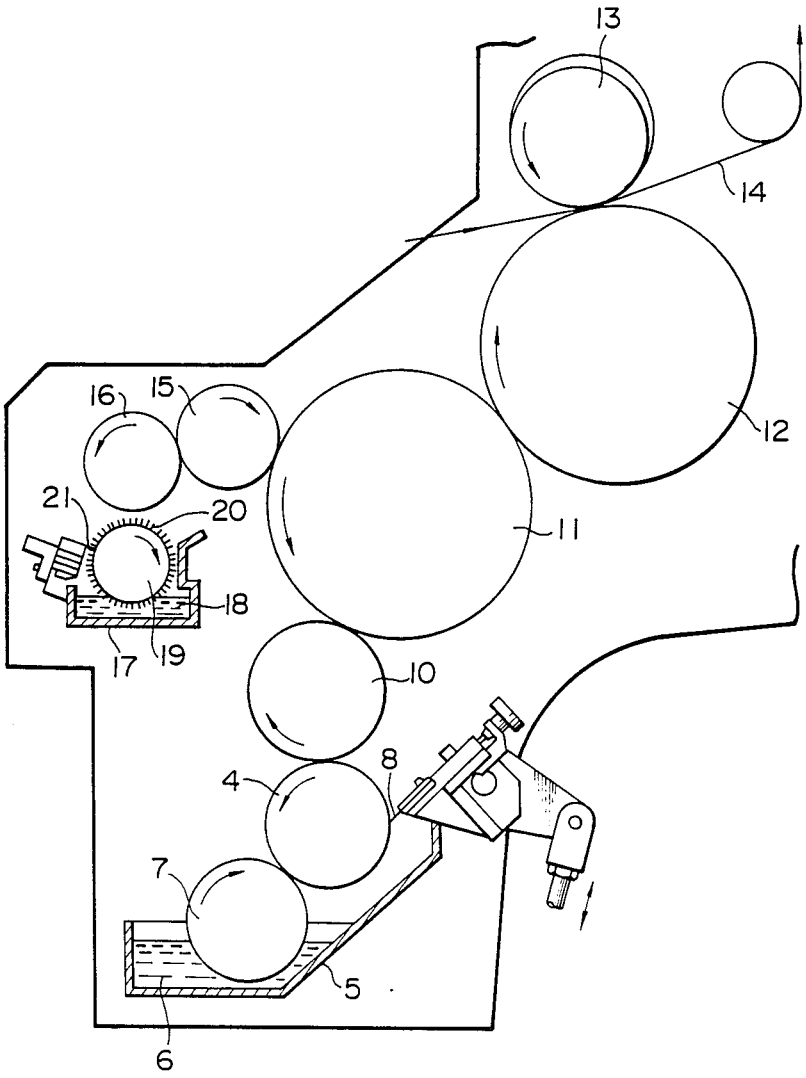
FIG. 1 is a schematic illustration showing an example of an offset printing system which employs a mesh roller.

Referring to FIG. 1, there is shown one example of a basic offset printing system employing a mesh roller 4. In this system, the ink 6 reserved in an ink pan 5 is sucked by a fountain roller 7 and transferred to the mesh roller 4. At the surface of the mesh roller 4 a doctor blade 8 is arranged in the reverse angle of the revolving direction of the mesh roller 4 so as to scrape the ink from the surface of the roller 4. According to this scraping motion the quantity of ink remaining on the roller 4 depends on the capacity of cells 2 recessed in the surface of the roller 4. The cells 2 are finely formed; for example, at the rate of 80 lines/cm. The remaining ink is supplied to the surface of a plate cylinder 11 through a form roller 10. The plate cylinder 11 contacts a blanket cylinder 12. The reference numerals 13 and 14 denote an impression cylinder and a paper web to be printed, respectively. On the other hand, the plate cylinder 11 further contacts with a form roller 15. This form roller 15 contacts with a dampening roller 16. Water (dampening solution) 18 reserved in a fountain pan 17 is sucked up by brush 20 set on a brush roller 19. The brush 20 is forcibly bent by a flicker blade 21, so that water is sputtered to the dampening roller 16 on account of the reaction of the brush 20 bent by the flicker blade 21. The water on the dampening roller 16 is transferred from the form roller 15 to the plate cylinder 11. In this offset printing system, the water supplied to the plate cylinder 11 is also transferred to the mesh roller 4 through the form roller 10.

The present invention will be described hereinafter with reference to the first embodiment thereof shown in FIG. 2 to FIG. 5.

The surface of the mesh roller 4 is formed with a plurality of recessed cells 2 and a protruded section 3. The center area of the protruded section 3 is made of the same material of the mesh roller 4; i.e., the mother member 1 of the mesh roller 4 is exposed. The mother member 1 is made of copper or copper alloy metal, or a lipophilic metal material having an affinity for ink and hydrophobic property.

The border edge 31 between the protruded section 3 and the cells 2 are coated with a layer, thickness of 5 to 20 μm, consisting of a high hard material 32 such as ceramics, tungsten carbide, or the like which are harder than the mother member 1. Alternatively, they are plated with a material, thickness of 5 to 20 μm, such as titanium nitride, titanium carbide, hard chromium, nickel composite material, or the like which are harder than the mother member 1.

Figure 2:
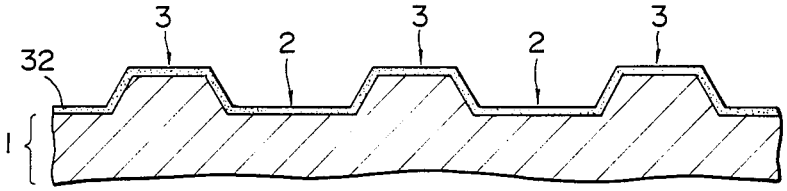
FIG. 2 is a schematic sectional view showing the surface of the mesh roller according to the first embodiment of the present invention, for explaining its manufacturing process.
Figure 3:
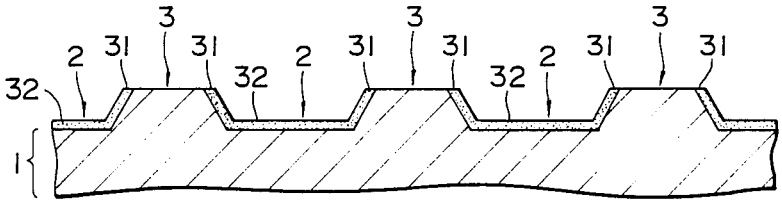
FIG. 3 is a partially enlarged sectional view showing the surface of the mesh roller according to the first embodiment.
Figure 4:
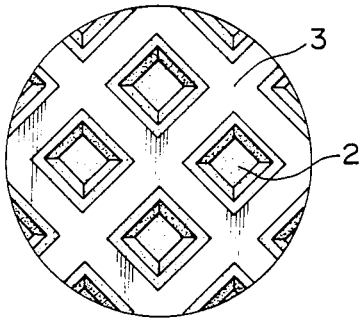
FIG. 4 is a partially enlarged plan view showing the surface of the mesh roller of the first embodiment.

FIG. 2 and FIG. 3 show the process for manufacturing the mesh roller according to the first embodiment of the present invention. First of all, the surface of the mother member 1 is wholly coated or plated with the above material so as to form the high hard material layer thereon. If the mother member 1 is made of a soft copper, the surface of the mother member 1 may be plated with a hard material such as nickel or the like as an under coating in order to improve the adhesion between the ceramic coating layer and the mother member 1. Thereafter the top surface of the protruded section 3 is subjected to an abrasion work so as to expose the mother base 1 as shown in FIG. 3 and FIG. 4. According to this abrasion work the hard material layer is wholly removed from the center area of the protruded section 3, but it remains at the border edge 31 between the protruded section 3 and the cells 2.

Figure 5:
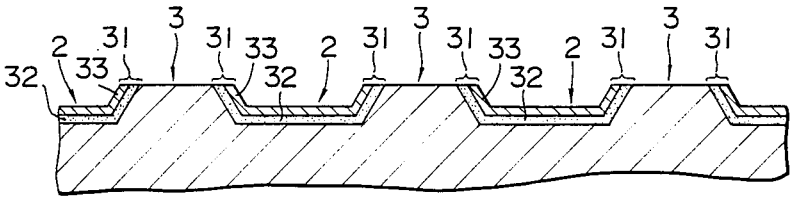
FIG. 5 is a partially enlarged sectional view showing the surface of the mesh roller modified of the first embodiment.

FIG. 5 shows one modification of the first embodiment, wherein the whole surface of the cells 2 and the external surface of the border edge 31 are covered with the lipophilic metal 33 as mentioned above. This modified configuration can be realized by abrading the top surface of the protruded section 3 to remove the copper or copper alloy layer coated or plated on the high hard material 32.

An operation of the planographic device employing the mesh roller according to the first embodiment or its modification will be described in connection with FIG. 1.

The ink 6 reserved in the ink pan 5 is sucked up by the fountain roller 7 and transferred to the mesh roller 4. The ink is scraped off from the surface of the mesh roller 4 by means of the doctor blade 8. After this scraping work, the cells 2 finely formed in the mesh roller 4 contain the predetermined quantity of ink. When the cells 2 are coated or plated with a copper or copper alloy layer 33 in addition to the high hard material 32 as shown in the modification shown in FIG. 5, the cells 2 may have an excellent affinity for ink in comparison with the single layered cells 2. Further the mesh roller 4 can be free from the water flowing back from the plate cylinder 11 since the mother member 1 of the mesh roller 4 is hydrophobic. Thus the ink is not diluted.

On the other hand, the border edge 31 of the top surface of the protruded section 3 is made of the material harder than that of the mother member 1, so that the high hard material edge 31 mainly receives the scraping stress from the doctor blade 8 so as to prevent the center area of the protruded section 3 of the mesh roller 4 from wearing. Even if the center area of the protruded section 3 is worn, the doctor blade 8 mainly applies the scraping stress towards the shoulder of the protruded section 3 and thus the center area of the protruded section 3 can avoid suffering from the stress directly applied by the doctor blade 8 until the shoulder made of the high hard material has been seriously worn. According to this, the surface of the protruded section will be uniformly worn. Further, as its working period is increased, the protruded surface 3 is gradually worn from its center area to the border edge 31. Therefore, the ratio of the center area having the affinity for ink and the border area 31 of the high hard edge in the protruded surface 3 is not so varied.

Subsequently, the second embodiment of the present invention will be described in connection with FIG. 6 to FIG. 10.

Figure 6:
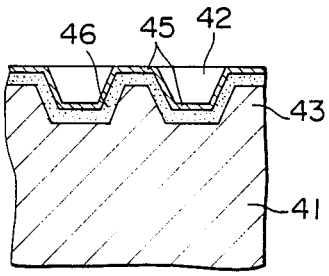
FIG. 6 and FIG. 7 are sectional views showing the surface of the mesh roller according to the second embodiment of the present invention for explaining its manufacturing process.
Figure 7:
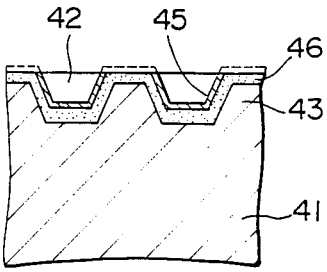

FIG. 6 and FIG. 7 show a process for manufacturing the mesh roller according to the second embodiment. A mother member 41 of this mesh roller is made of steel base material. The surface of the protruded section 43 of the mesh roller is composed of a mixture layer 46 wherein a high hard material 44 such as ceramics, tungsten carbide, or the like and a lipophilic metal material 45 such as copper or the like are finely mixed. The surface of cells 42 is composed of or covered with the lipophilic metal material as the above.

The mesh roller according to the second embodiment is produced in the following process.

First of all, the whole surface of the mesh roller made of steel base material is uniformly coated with a high hard material such as ceramic and/or tungsten carbide, and thereafter a lipophilic metal material such as copper is uniformly coated or plated on the high hard material layer. According to this treatment, the whole surface of the mesh roller refuses water and the ink can be spread well. Under this condition, the mesh roller is set in its ink supplying system and its operation starts. The lipophilic metal layer 45 formed on the protruded surface 43 will be gradually worn on account of the scraping stress from the doctor blade or an additional abrasive. In due course, the high hard material layer under there will expose and finally the wearing at the surface will not progress at all; as shown in FIG. 7.

Figure 8:
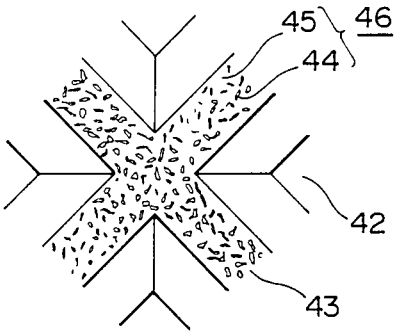
FIG. 8 is a partially enlarged sectional view whowing the surface of the mesh roller according to the second embodiment.

The surface of the exposed high hard material layer 44 will form many pores after suffering from wearing as shown in FIG. 8, but these pores have been previously or will be stuffed with the lipophilic metal material 45 disposed on the high hard layer 44. Finally, this will become a smooth surface in which the lipophilic metal material 45 stuffed in the many pores is uniformly and finely disposed in the high hard material layer 44. This surface will have both wear resistance and affinity for ink (water refusing property) and additionally facilitate the ink scraping work. Copper alloy may be used for the lipophilic metal material.

Figure 9:
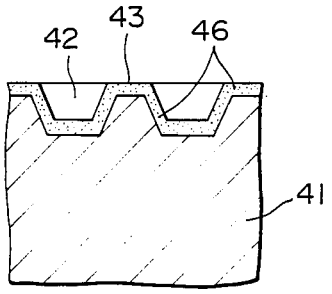
FIG. 9 is a partially enlarged sectional view showing the surface of the mesh roller modified of the second embodiment.
Figure 10:
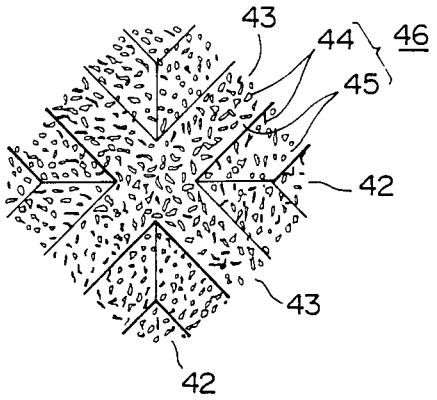
FIG. 10 is a partially enlarged plan view showing the surafce of the mesh roller modified of the second embodiment.

FIG. 9 and FIG. 10 show a modification of the second embodiment. This modified mesh roller is produced in the following manner. In detail, the whole surface of the cells 42 in mesh shape and the protruded section 43 of the mesh roller 41 made of steel base material is uniformly coated with the mixture of the high hard material 44 and the lipophilic metal material 45 by means of a plasma deposition. Thus the high hard material 44 and the lipophilic metal material 45 are finely mixed and uniformly layered on the whole surface of the mesh roller as shown in FIG. 10. This modified mesh roller may provide the same effect as the second embodiment and further an additional advantage that the surface configuration of the mesh roller will not be varied even if it has suffered from wearing by the doctor blade 8.

Of course, copper alloy may be used for the lipophilic metal material instead of copper.

In the above described first and second embodiments and their modifications, the mesh roller 4 is formed with the mesh pattern at the rate of 200 to 400 lines per inch and each cell has a depth of 50 μm or less. The average particle size of the copper and ceramics is 30 μm or less. The volume ratio between the ceramic powder and the copper powder is 50% or less. The flame coated layer of the mixture of the copper powder and the ceramic powder is 30 μm or less.

As many apparently widely different embodiments of this invention may be made without departing from the spirit and scope thereof, it is to be understood that the invention is not limited to the specific embodiments thereof except as defined in the appended claims.

What is claimed is:

1. A mesh roller for planography, having an external surface comprising a protruded surface and a plurality of fine cells for storing ink, wherein the external surface is made of or covered with a mixture of a high hard material and a lipophilic metal material which are finely mixed with each other.

2. A mesh roller as recited in claim 1, wherein only the protruded surface is composed of or covered with a mixture of a high hard material and a lipophilic metal material which are finely mixed with each other.

3. A mesh roller as recited in claim 2 wherein the high hard material is mainly composed of tungsten carbide.

4. A mesh roller as recited in claim 3 wherein the lipophilic metal material is mainly composed of copper or copper alloy.

5. A mesh roller as recited in claim 2 wherein the lipophilic metal material is mainly composed of copper or copper alloy.

6. A mesh roller as recited in claim 1, wherein the whole surface of the mesh roller is composed of or covered with a mixture of a high hard material and a lipophilic metal material which are finely and uniformly mixed with each other.

7. A mesh roller as recited in claim 1, wherein the surface of the cells is composed of or covered with a lipophilic metal material.

8. A mesh roller as recited in claim 1, wherein the lipophilic metal material is mainly composed copper or copper alloy.

9. A mesh roller as recited in claim 1, wherein the high hard material is mainly composed of ceramics.

10. A mesh roller as recited in claim 1, wherein the high hard material is mainly composed of tungsten carbide.

11. A mesh roller as recited in claim 1, wherein the high hard material comprises a hard plated material mainly composed of titanium nitride.

12. A mesh roller as recited in claim 1, wherein the high hard material comprises a hard plated material mainly composed of titanium carbide.

13. A mesh roller as recited in claim 1, wherein the high hard material comprises a hard plated material mainly composed of a hard chromium.

14. A mesh roller as recited in claim 1, wherein the high hard material comprises a hard plated material mainly composed of nickel composite material.

15. A mesh roller for planography, having an external surface comprising a protruded surface and a plurality of fine cells for storing ink, wherein the center area of the protruded surface is composed of or covered with a lipophilic metal material and the border edge between the protruded surface and the cells is composed of or covered with a high hard material.

* * * * *